US007922286B2

(12) United States Patent
Miyazaki

(10) Patent No.: US 7,922,286 B2
(45) Date of Patent: Apr. 12, 2011

(54) IMAGE RECORDING APPARATUS

(75) Inventor: Yasuhiro Miyazaki, Tokyo (JP)

(73) Assignee: Olympus Corporation, Tokyo (JP)

( * ) Notice: Subject to any disclaimer, the term of this patent is extended or adjusted under 35 U.S.C. 154(b) by 721 days.

(21) Appl. No.: 11/975,899

(22) Filed: Oct. 22, 2007

(65) Prior Publication Data

US 2008/0094443 A1 Apr. 24, 2008

(30) Foreign Application Priority Data

Oct. 23, 2006 (JP) ..... 2006-287317

(51) Int. Cl.
*B41J 23/00* (2006.01)

(52) U.S. Cl. ..... 347/38

(58) Field of Classification Search ..... 347/19, 347/108, 38

See application file for complete search history.

(56) References Cited

U.S. PATENT DOCUMENTS

| | | | | |
|---|---|---|---|---|
| 5,397,192 | A * | 3/1995 | Khormaee | 400/708 |
| 2002/0041300 | A1 * | 4/2002 | Iwasaki et al. | 347/19 |

FOREIGN PATENT DOCUMENTS

| | | | |
|---|---|---|---|
| JP | 63-135252 | A | 6/1988 |
| JP | 07-200792 | A | 8/1995 |
| JP | 2516606 | B2 | 4/1996 |
| JP | 2003-094615 | A | 4/2003 |

* cited by examiner

*Primary Examiner* — Laura E Martin
(74) *Attorney, Agent, or Firm* — Holtz, Holtz, Goodman & Chick, PC

(57) ABSTRACT

An image recording apparatus includes: a recording medium conveying mechanism; a recording head for recording an image on a recording medium based on the input data; a faulty record detection unit for detecting a faulty record when a recording process is performed; and a control unit for controlling these components. With the configuration, the recording head and the faulty record detection unit are arranged opposite at least one conveying unit, the recording head and the faulty record detection unit are fixed to the same coupling member, and the coupling member is fixed to a fixing member of the recording medium conveying mechanism.

6 Claims, 6 Drawing Sheets

IMAGE RECORDING APPARATUS

CROSS REFERENCE TO RELATED APPLICATIONS

This application is based upon and claims the benefit of priority from the prior Japanese Patent Application No. 2006-287317, filed Oct. 23, 2006, the entire contents of which are incorporated hereinto by reference.

BACKGROUND OF THE INVENTION

1. Field of the Invention

The present invention relates to an image recording apparatus for recording an image by fixing ink etc. on a recording medium such as paper, film, etc., and more specifically to an image recording apparatus provided with a faulty record detection unit for use in performing a recording process on the recording medium based on record data from a recording head of an image recording apparatus.

2. Description of the Related Art

As an image recording apparatus, for example, an inkjet printer discharges ink drops from a plurality of nozzles of a recording head to a recording medium held and conveyed by a conveying mechanism, and records a high quality image at a high speed.

The inkjet printer is widely utilized for office use in recording an image on a recording medium (paper) in the form of, for example, a cut sheet. Recently, the throughput of an inkjet printer can be improved by configuring a line head by arranging a number of recording heads in the direction orthogonal to the direction of conveying a recording medium, and thus the inkjet printer is also utilized for industrial use in recording an image on a recording medium (continuous paper) such as roll paper etc.

In an image recording apparatus for recording an image by fixing ink on a recording medium such as a large volume of paper, film, etc., the image can be recorded while conveying the recording medium at a high speed of several tens to several hundreds meters/min.

When the images are recorded at a high speed as described above, a verification cannot be visually made by a person as to whether or not the image data transmitted from a host apparatus matches the recorded image. Even when an image is recorded at a low speed, there can be a case where the image is not correctly verified visually by a person.

In the image recording apparatus, a recorded image is electronically read and compared with an image represented by image data from the host apparatus dot by dot, thereby detecting a faulty record.

For example, the patent document (Japanese Published Patent No. 2516606) discloses an invention of a print quality test device for use in a roll paper printer for continuously printing a picture pattern on roll paper. The device includes: a sensor device which is provided in a predetermined position in a printer, reads a picture pattern while conveying printed matter, and obtains an image signal; a device for detecting a start mark printed in advance at the head of each picture pattern while conveying printed matter; a device for obtaining the amount of a travel shift in the direction of the width of roll paper based on the fluctuation of the edge position in the direction of the width of the start mark, a device for interpolating the image signal read by the sensor device in the direction of the width of the roll paper based on the amount of a travel shift; and a device for testing the print quality of each picture pattern by comparing the corrected image signal with an image signal of a reference picture pattern.

The patent document (Japanese Published Patent Application No. H7-200792) discloses an invention of a printed matter test device for detecting in line an abnormal condition occurring on each piece of printed matter by comparing a test image obtained by sequentially taking the picture pattern of continuously traveling printed matter arranged at predetermined pitches with a predetermined reference image pixel by pixel. The device includes: a timing device for generating a timing pulse depending on the traveling speed of the printed matter; a read device for generating a sequential test image by operating according to the sampling pulse synchronous to the timing pulse, and reading a picture pattern line by line; a extraction device for selectively extracting from the sequential test image a local pattern specified in advance in the picture pattern based on the array pitch of the printed matter; an arithmetic device for performing an image arithmetic process on an extracted local pattern, and sequentially calculating the position information in a sub-pixel unit; and a synchronization device for performing a fine adjustment on the phase of a sampling pulse according to the position information, and synchronizing it with the timing pulse in a sub-pixel unit for each array pitch of the printed matter

SUMMARY OF THE INVENTION

The image recording apparatus relating to the main aspect of the present invention includes a recording medium conveying mechanism, a recording head for recording an image on a recording medium based on the input data, a faulty record detection unit for detecting a faulty record when a recording process is performed, and a control unit for controlling these components. In the image recording apparatus, the recording head and the faulty record detection unit are arranged opposite at least one conveying unit, the recording head and the faulty record detection unit are fixed to the same coupling member, and the coupling member is fixed to a fixing member of the recording medium conveying mechanism. With the configuration, the apparatus can correctly detect a faulty record with little edge position shift of a read image or conveying direction timing, without the necessity of correction, and with capability for easy correction as necessary.

DESCRIPTION OF THE PREFERRED EMBODIMENTS

The mode for embodying the present invention is described below with reference to the attached drawings. In the following descriptions, the conveying direction of a recording medium is defined as a secondary scanning direction, and the direction orthogonal to the conveying direction is defined as a primary scanning direction.

The first mode for embodying the present invention is described below with reference to FIGS. 1 through 3.

Figure 1:
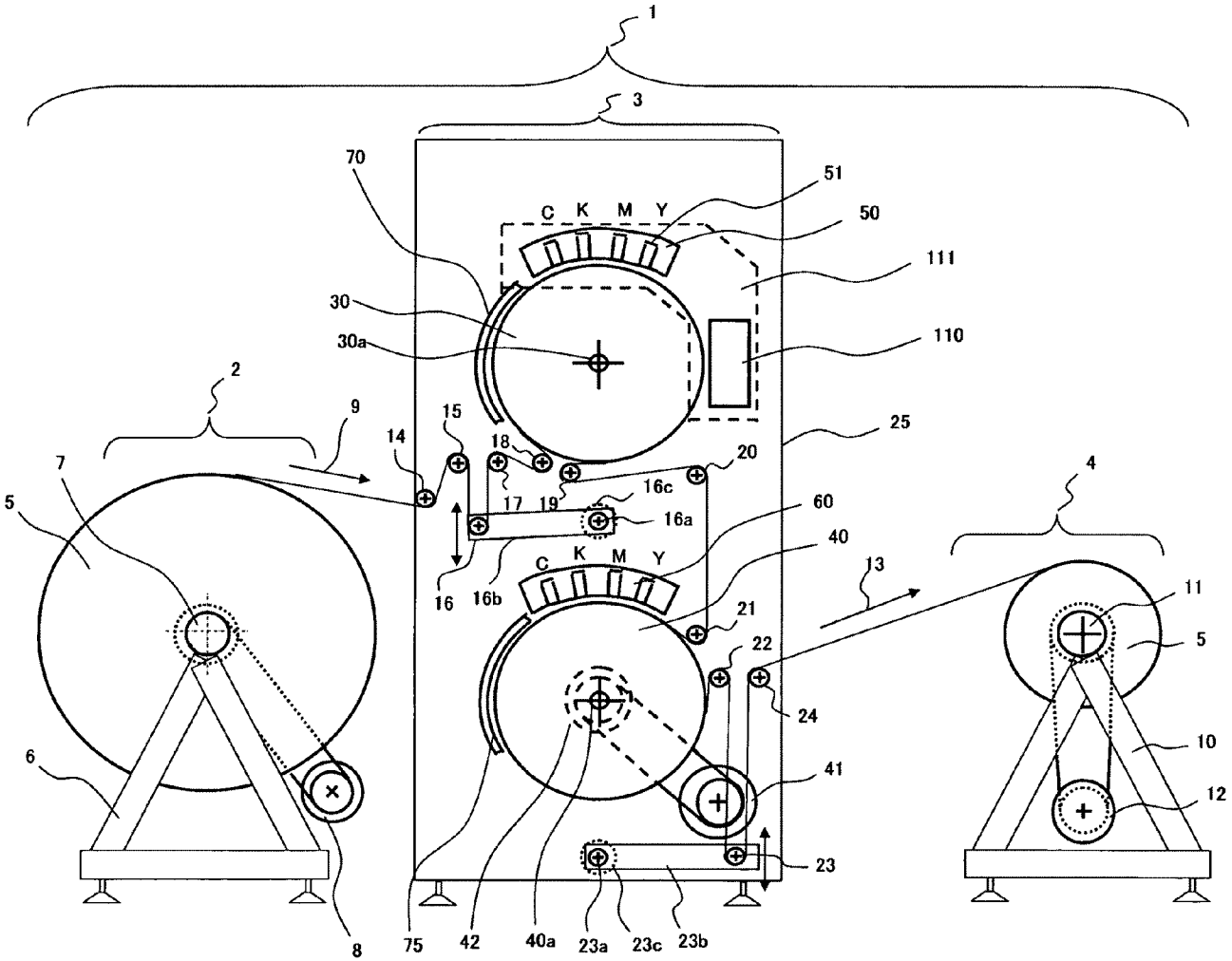
FIG. 1 is a rough front view of the image recording apparatus according to the first mode for embodying the present invention.

FIG. 1 is a rough front view of the conveying route of a recording medium 5 in an image recording apparatus 1 according to the mode for embodying the present invention. The image recording apparatus 1 of the present mode for embodying the present invention includes an unwinder unit 2, a printer unit 3, and a rewinder unit 4. FIG. 2 is a rough side view of the printer unit 3 of the image recording apparatus 1 according to the present mode for embodying the present invention.

First described is the unwinder unit 2.

The unwinder unit 2 is provided with a stand 6 and a paper pipe fixing shaft 7. The unwinder unit 2 is an unrolling unit for holding the recording medium 5 such that the recording medium 5 can rotate, and unrolling the recording medium 5. In the present mode for embodying the present invention, roll paper is used as a recording medium for the unwinder unit 2. The sizes of the roll paper that can be loaded into the unwinder unit 2 are 328 mm (12.5 inch) in width, 0.7 m in diameter, and 110 kg in weight.

The stand 6 supports the paper pipe fixing shaft 7 such that the shaft can rotate. A plurality of nails for chucking the inner perimeter of the paper pipe of the paper pipe fixing shaft 7 are projected in the radius direction by injecting air from the air injection hole not shown in the attached drawings. Thus, the nails of the paper pipe fixing shaft 7 are engaged in the inner perimeter of the paper pipe of the recording medium 5, and holds the recording medium 5.

A driving motor 8 for unrolling the medium is connected to the paper pipe fixing shaft 7 through a pulley and a belt. The driving force of the driving motor 8 is transmitted to the paper pipe fixing shaft 7, and unrolls the recording medium 5 in the direction of an arrow 9. A powder clutch not shown in the attached drawings is arranged between the pulley and the driving motor 8. The powder clutch has the function of applying a tension in the direction opposite to the conveying direction of the recording medium 5.

Described next is the printer unit 3. The printer unit 3 introduces the recording medium 5 conveyed from the unwinder unit 2, winds and holds the recording medium 5 around a first drum 30. The printer unit 3 conveys the recording medium 5 directly below a first print unit 50 arranged opposite the first drum 30, and performs printing on the surface of the recording medium 5. After the printing on the surface of the recording medium 5, the printer unit 3 winds and holds the recording medium 5 around a second drum 40. Then, the printer unit 3 conveys the recording medium 5 immediately below a second print unit 60 arranged opposite the second drum 40, performs printing on the reverse of the recording medium 5, and feeds the recording medium 5 to the rewinder unit 4.

Figure 2:
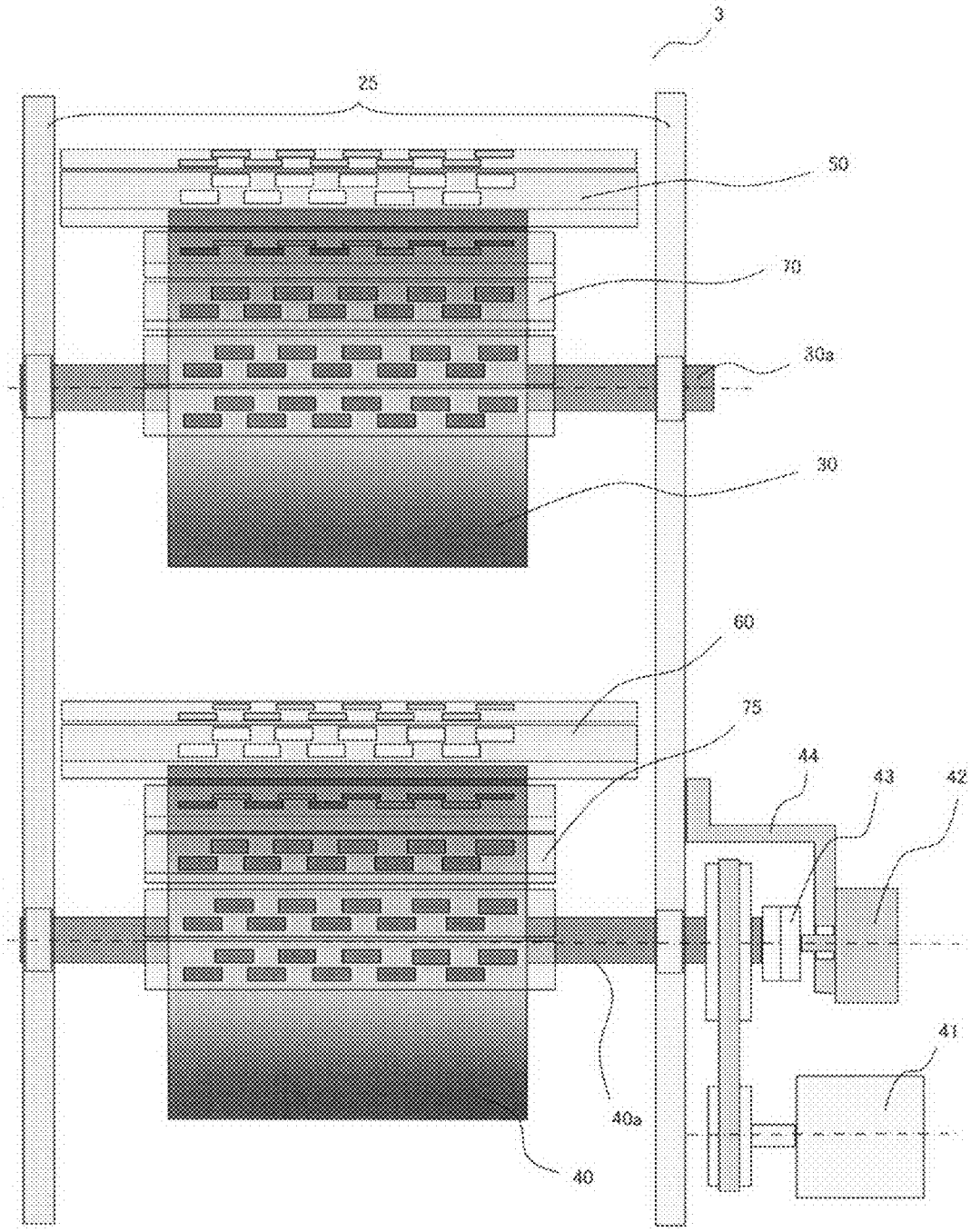
FIG. 2 is a rough side view of the conveying system of the printer unit of the image recording apparatus according to the first mode for embodying the present invention.

The printer unit 3 is configured by a plurality of rollers, a conveying unit of the recording medium 5 including a first drum 30 and a second drum 40, a body frame 25, the first print unit 50, the second print unit 60, the first maintenance unit 70, and a second maintenance unit 75 as shown in FIGS. 1 and 2.

First, the conveying unit of the recording medium 5 is described below. The recording medium 5 unrolled from the unwinder unit 2 conveyed to the first drum 30 through free rollers 14 and 15, a first dancer roller 16, and free rollers 17 and 18.

The first dancer roller 16 is held on the body frame 25 at the tip of an arm 16*b* having a rotation center 16*a*. The first dancer roller 16 has a tension generation unit for applying a tension to the recording medium 5 wound around the first dancer roller 16 by the tare of the first dancer roller 16 and the arm 16*b*.

The tension generation unit also has the function of taking up the slack caused by the fluctuation of the tension from a displaced core in the recording medium 5 held by the unwinder unit 2. The rotation center 16*a* is provided with a potentiometer 16*c* for detecting the position of the rotation when the first dancer roller 16 moves up and down. According to the output signal of the potentiometer 16*c*, the powder clutch connected to the paper pipe fixing shaft 7 of the unwinder unit 2 is operated, thereby controlling the tension of the recording medium 5. The free rollers 14, 15, 17, and 18 are supported by the body frame 25 such that they can rotate.

Described below is the configuration of the first drum 30. The first drum 30 is a hollow aluminum cylinder. A rotation shaft 30*a* of the first drum 30 is supported by the body frame 25 such that the shaft can rotate. One end of the member for supporting the first maintenance unit 70 described later is engaged in the rotation shaft 30*a*. The first drum 30 of the present mode for embodying the present invention can wind the recording medium 5 at a 330° angle, and the perimeter corresponding to the length of three times a sheet of the A3 size (420 mm) is set at a 330° winding angle.

The vertical drag is applied to the outer surface of the first drum 30 by the tension of the start and the end of the roll of the recording medium 5 on the first drum 30, and the recording medium 5 is held on the first drum 30 by the friction between the first drum 30 and the recording medium 5. With the configuration, the first drum 30 can be a driven drum rotating by the second drum 40 through the recording medium 5.

At and after the end of rolling the first drum 30, the recording medium 5 is conveyed to the second drum 40 through the free rollers 19, 20, and 21.

Described below is the configuration of the second drum 40. Like the first drum 30, the second drum 40 is a hollow aluminum cylinder. A rotation shaft 40*a* of the second drum 40 is engaged in one end of the member supporting the second maintenance unit 75 described later. The rotation shaft 40*a* of the second drum 40 is supported by the body frame 25 such that the shaft can rotate.

Also on the second drum 40 according to the present mode for embodying the present invention, the recording medium 5 is wound at a 330° winding angle, and the perimeter corresponding to the length of three times a sheet of the A3 size (420 mm) is set at a 330° winding angle. The vertical drag is applied to the outer surface of the second drum 40 by the tension of the start and the end of the roll of the recording medium 5 on the second drum 40. Thus, the friction grows between the second drum 40 and the recording medium 5, the recording medium 5 does not slide on the second drum 40, and the recording medium 5 is tightly held on the second drum 40.

The recording medium 5 held on the second drum 40 is conveyed by the driving force of a driving motor 41 connected through the pulley and the belt connected to the rotation shaft 40*a* of the second drum 40. With the configuration, the second drum 40 is a driven drum.

An encoder 42 in the position detection unit is connected to the rotation shaft 40*a* of the second drum 40 through a coupling 43. The housing of the encoder 42 is fixed to one end of an encoder fixing member 44 having an L-shaped section, and the other end of the encoder fixing member 44 is fixed to the back of the body frame 25. With the configuration, the rotation shaft of the encoder 42 rotates with the rotation of the second drum 40, and outputs the detection pulse corresponding to the rotation position of the second drum 40. Then, the detection pulse output from the encoder 42 is input to the driving substrate not shown in the attached drawings but driving the recording heads of the first print unit 50 and the second print unit 60, and the recording head discharges ink in synchronization with the detection pulse.

The encoder 42 uses an existing rotary encoder of, for example, 18000 pulses per rotation. The resolution in the conveying direction in a printing process is 300 dpi, and 1 print dot per pulse of the encoder 42 is set. Thus, when a rotary encoder of 18000 pulse per rotation is used, the diameter of the second drum 40 is 25.4 mm÷300 dpi×18000 pulses÷the ratio of the circumference of a circle to its diameter $\pi$=485 mm In the present mode for embodying the present invention, the diameter of the first drum 30 is the same as the diameter of the second drum 40. With the configuration, in synchronization with the detection pulse of the encoder 42, the recording heads of the first print unit 50 and the second print unit 60 discharge ink, and the printing process of the resolution of 300 dpi in the conveying direction can be performed.

After the end of the roll of the second drum 40, the recording medium 5 is fed to the rewinder unit 4 through a free roller 22, a second dancer roller 23, and a free roller 24.

The second dancer roller 23 is held at the tip of an arm 23*b* having a rotation center 23*a* of the body frame 25 such that the roller can rotate. The second dancer roller 23 has a tension generation unit for applying a tension to the recording medium 5 wound around the second dancer roller 23 by the tare of the second dancer roller 23 and the arm 23*b*.

The tension generation unit also has the function of taking up the slack caused by the fluctuation of the tension from a displaced core in the recording medium 5 held by the unwinder unit 4. The rotation center 23*a* is provided with a potentiometer 23*c* for detecting the position of the rotation when the second dancer roller 23 moves up and down. According to the output signal of the potentiometer 23*c*, the clutch connected to the paper pipe fixing shaft 11 of the unwinder unit 4 is operated, thereby controlling the tension of the recording medium 5. The free rollers 22 and 23 are supported by the body frame 25 such that they can rotate.

Next, the rewinder unit 4 is described below.

The rewinder unit 4 is provided with a stand 10 and a paper pipe fixing shaft 11. The rewinder unit 4 is a takeup unit for holding the taken up recording medium 5 such that the medium can rotate, and taking up the recording medium 5 from the printer unit 3.

The stand 10 supports the paper pipe fixing shaft 11 such that the shaft can rotate, and holds the recording medium 5 taken up by the paper pipe fixing shaft 11. Like the paper pipe fixing shaft 7, the paper pipe fixing shaft 11 has a plurality of nails projecting in the radii direction by injecting air from the air inlet, and the nails are engaged in the inner surface of the paper pipe of the taken up recording medium 5, thereby holding the recording medium 5.

A takeup driving motor 12 is connected to the paper pipe fixing shaft 11 through a pulley and a belt. The driving force of the driving motor 12 is transmitted to the paper pipe fixing shaft 11, and takes up the recording medium 5 in the direction of an arrow 13. A powder clutch is provided between the pulley and the take-up driving motor 12, and the powder clutch adjusts the tension of the recording medium 5 in the conveying direction.

Described below are the first print unit 50 and the second print unit 60. As shown in FIGS. 1 through 3, the first print unit 50 and the second print unit 60 are ink discharge device for discharging ink to the recording medium 5. FIG. 3 is a rough front view of the first print unit 50 arranged opposite the first drum 30.

The first print unit 50 according to the present mode for embodying the present invention has recording heads 51*a*, 51*b*, 51*c* and 51*d* for a total of four colors, that is, cyan (C), black (K), magenta (M), and yellow (Y). The recording heads 51*a*, 51*b*, 51*c* and 51*d* are zigzag arranged and fixed for the width or more of the recording medium 5 on head holding plates 52*a*, 52*b*, 52*c*, and 52*d*. The relative positions of the recording heads 51*a*, 51*b*, 51*c* and 51*d* are set with respect to the first drum 30 by the head holding plates 52*a*, 52*b*, 52*c*, and 52*d* and a coupling plate 111 described later.

The configuration of the above-mentioned first print unit 50 is the same as the configuration of the second print unit 60.

Described next are the first maintenance unit 70 and the second maintenance unit 75. FIG. 3 if a rough front view of the first maintenance unit 70 arranged opposite the first drum 30. The first maintenance unit 70 and the second maintenance unit 75 have the function of performing a maintaining operation including wiping, nozzle suction, etc. to prevent clogging in the nozzles of the recording heads.

The first maintenance unit 70 is formed by a plurality of suction nozzles 71 corresponding to the recording heads 51*a*, 51*b*, 51*c* and 51*d* of the first print unit 50, four first ink pans 72 for collecting ink purged when the maintaining operation is performed and corresponding to the recording heads 51*a*, 51*b*, 51*c* and 51*d*, a second ink pan 73 formed by a metal plate etc. covering the four first ink pans 72 into an incorporated unit, and a maintenance unit holding member 74 for positioning the components with respect to the first drum 30 and holding them.

The suction nozzles 71 suck ink from the recording heads 51*a*, 51*b*, 51*c* and 51*d*, and remove the ink, paper duct, etc. adhering to the nozzle surfaces. The first ink pans 72 collect the ink purged during the maintaining operation. The maintenance unit holding member 74 positions and holds the above-mentioned components (the suction nozzles 71, the first ink pans 72, and the second ink pan 73) with respect to the first drum 30 for engagement in the rotation shaft 30*a* of the first drum 30.

The maintaining operation first saves the recording heads 51*a*, 51*b*, 51*c* and 51*d* of the first print unit 50. Afterwards, the first maintenance unit 70 is moved immediately below the recording heads 51*a*, 51*b*, 51*c* and 51*d*, and an ink purging operation is performed on the recording heads 51*a*, 51*b*, 51*c* and 51*d*. The ink flowing after the purging operation is collected by the four first ink pans 72 corresponding to the recording heads 51*a*, 51*b*, 51*c* and 51*d*, and stored in the waste tank not shown in the attached drawings. Then, the suction nozzles 71 contacting the nozzle surfaces of the recording heads 51*a*, 51*b*, 51*c* and 51*d* are scanned in the direction of the nozzle string, the suction nozzles 71 remove the ink and paper dust adhering to the nozzle surfaces, and suck the ink remaining on the nozzle surfaces.

Figure 3:
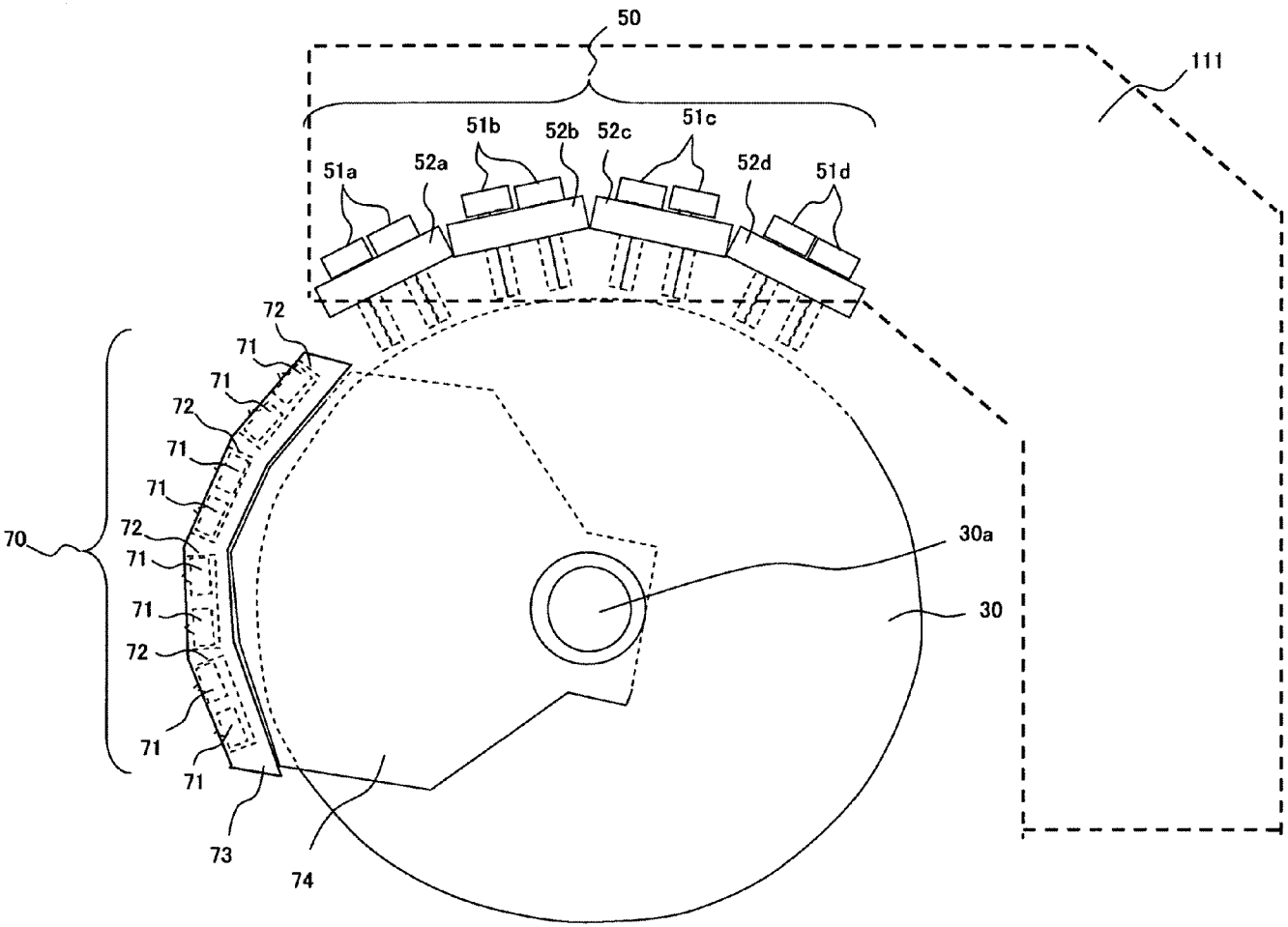
FIG. 3 is a rough front view of the first print unit arranged opposite the first drum of the image recording apparatus according to the first mode for embodying the present invention.

After the maintaining operation, control is returned to, for example, the standby position shown in FIG. 3. At this time, since the first maintenance unit 70 enters the standby state in a tilted position, there is the possibility that the ink remaining in the first ink pans 72 drops. The second ink pan 73 is provided as a countermeasure. The end portion of the second ink pan 73 is formed by a wall having a sharp bending angle. Although the ink remaining in the first ink pans 72 drops by inclining the pan toward the back of the apparatus, the ink is kept in the end portion. The ink stored in the second ink pan 73 flows into the waste tank.

The configuration of the first maintenance unit 70 is the same as the configuration of the second maintenance unit 75.

Described below is the conveying operation of the recording medium 5.

Before starting the conveying operation of the recording medium 5, the operation of applying tension to the recording medium 5 is performed.

A powder clutch coupled to the paper pipe fixing shaft 7 is operated according to the output signal of the potentiometer 16*c* such that the first dancer roller 16 can be set in a neutral position (the arm 16*b* can be substantially in a horizontal state), the power of the unrolling driving motor 8 is transmitted, and the tension of the recording medium 5 is controlled. Thus, upstream the conveying path of the recording medium 5, that is, from the first dancer roller 16 to the start of the roll of the recording medium 5 at the first drum 30, the tension of half the tare of the first dancer roller 16 and the arm 16*b* is applied.

On the other hand, a clutch coupled to the paper pipe fixing shaft 11 is operated according to the output signal of the potentiometer 23*c* such that the second dancer roller 23 can be set in a neutral position (the arm 23*b* can be substantially in a horizontal state), and the tension of the recording medium 5 is controlled. Thus, downstream the conveying path of the recording medium 5, that is, from the end of the roll of the second drum 40 to the second dancer roller 23, the tension of half the tare of the second dancer roller 23 and the arm 23*b* is applied.

At this time, the vertical drag is applied to the outer surface of the first drum 30 by the tension of the start and the end of the roll of the recording medium 5 on the first drum 30. Thus, the recording medium 5 is tightly held on the first drum 30 by the friction generated between the first drum 30 and the recording medium 5. Similarly, the vertical drag is applied to the outer surface of the second drum 40 by the tension of the start and the end of the roll of the recording medium 5 on the second drum 40. Thus, by the friction between the second drum 40 and the recording medium 5, the recording medium 5 is tightly held on the second drum 40.

When the conveying operation of the next recording medium 5 is started, the driving motor 41 coupled to the second drum 40, the unrolling driving motor 8 of the unwinder unit 2, and the take-up driving motor 12 of the rewinder unit 4 are driven, thereby driving the first drum 30 and conveying the recording medium 5. At this time, the recording medium 5 can be conveyed without slipping between the outer surfaces of the first drum 30 and the rewinder unit 4 and the recording medium 5.

The operation of applying the tension to the recording medium 5 can be obtained simultaneously at the start of the conveying operation. In the present mode for embodying the present invention, the second drum 40 is a driving drum and the first drum 30 is a driven drum. However, the first drum 30 can be a driving drum, and the second drum 40 can be a driven drum.

Described below is the printing operation of the recording medium 5.

When the printing operation is started, the tension generating operation and the conveying operation of the recording medium 5 are started, the encoder 42 coupled to the rotation shaft 40*a* of the second drum 40 outputs the detection pulse corresponding to the rotation position of the second drum 40. Based on the detection pulse, the recording head of the first print unit 50 is first driven, and the first print unit 50 performs the printing process on the recording medium 5.

Next, the second print unit 60 prints data on the reverse of the print surface of the recording medium 5 printed by the first print unit 50, thereby performing double-sided printing. When the double-sided printing is performed, the registration of the print surface of the recording medium 5 printed by the first print unit 50 and the print surface of the recording medium 5 printed by the second print unit 60 is attained by converting in advance the length of the conveying path from the printing position of the recording head for cyan (C) of the first print unit 50 on the recording medium 5 to the printing position of the cyan (C) of the second print unit 60 on the recording medium 5 into the number of detection pulses of the encoder 42, and starting the printing by the second print unit 60 when the number of detection pulses of the encoder 42 reaches a predetermined number of delayed pulses after the printing by the first print unit 50.

In the present mode for embodying the present invention, the encoder 42 is coupled only to the second drum 40, but the encoder 42 can also be coupled only to the first drum 30.

Described next is the arrangement of the first drum 30 and the second drum 40.

In the present mode for embodying the present invention, the rotation shaft 30*a* of the first drum 30 and the rotation shaft 40*a* of the second drum 40 are arranged such that they can be on the same shaft extending up and down (vertical direction) as viewed from the front of the apparatus. Thus, the diameter of 485 mm of the first drum 30 and the second drum 40 and the necessary space for the arrangement of each roller determine the width of the apparatus.

Described next are the configuration, the operation, and the fixed arrangement of the first print unit 50 arranged on the perimeter of the first drum 30 and the faulty record detection unit 110.

The faulty record detection unit 110 detects a faulty record when a recording process is performed on a recording medium by discharging ink from nozzles based on the image data transmitted from the host apparatus that transmits original information to be recorded. The faulty record detection unit 110 is configured by an illumination unit, a capture unit, a conveying unit, and a faulty record detection unit. The illumination unit emits illumination light to the surface of the recording medium after the recording process. The capture unit captures the surface of the recording medium irradiated by the illumination light through a lens, and outputs a detected image. The conveying unit conveys the recording medium while maintaining the position relationship between the surface of the recording medium and the facing capture unit. The faulty record detection unit determines the presence/absence of the occurrence of a faulty record based on the comparison result between the image data and the detected image.

The operation according to the present mode for embodying the present invention is performed as follows. First, the image data transmitted from the host apparatus that transmits the original information to be recorded is input to the control unit not shown in the attached drawings. The control unit performs normal control as an image recording apparatus by controlling the discharge of the ink from the recording heads 51*a*, 51*b*, 51*c* and 51*d* of the first print unit 50 by the appropriate mapping and density by developing the image data, controlling the conveyance by the conveying mechanism, and by controlling the adjustment of the recording timing with the recording head.

Furthermore, the control unit also performs a controlling process as a faulty record detection unit, and controls the faulty record detector configured by the capture unit, the illumination unit built in the faulty record detection unit 110, and the faulty record detection unit.

Furthermore, the control unit appropriate controls the operation of the faulty record detection unit 110 based on the image data received from the host apparatus and the conveying timing of the conveying mechanism, and performs integral control for a post-process performed when a faulty record is determined.

The control unit has a processing circuit including an MPU (arithmetic operation processing device) having the controlling function and the arithmetic function, ROM storing a control program, and non-volatile memory for storing a set value etc. relating to the control of the apparatus, but not shown in the attribute. The control unit realizes various controlling processes by the MPU executing a predetermined control program.

When the control unit acquires the image data transmitted from the host apparatus, the control unit temporarily stores the data in the memory of the control unit not shown in the attached drawings. It notifies the first print unit 50 of the image data in the first line through the n-th line (n is an integer of 2 or more) in the image data, and allows it to perform a recording process.

Described below are the fixing and arranging operations.

When a faulty record is detected, the presence/absence of an occurrence of a faulty record is determined based on the result of comparing the image data transmitted from the host apparatus with the detected image detected by the faulty record detection unit 110. Therefore, if the position of the dot recorded on the recording medium 5 is shifted in the primary scanning direction or the secondary scanning direction before the position can be the detection vision position of the faulty record detection unit 110 by the rotation of the first drum 30, then the positions of the dots to be compared do not match, thereby failing in detecting faulty record.

On the other hand, in the present mode for embodying the present invention, a conveying system in which the recording medium 5 tightly contacts the cylindrical surface of the first drum 30 fixed to the body frame 25 is used as shown in FIG. 1, and it is fixed to the 25 such that the recording head 51 (51*a*, 51*b*, 51*c* and 51*d*) can be positioned upstream on the perimeter of one drum, and the faulty record detection unit 110 can be positioned downstream thereon.

Thus, a constant position of the dot to be compared on the recording medium 5 can be maintained without a shift in principle in the primary scanning direction with respect to the repetition of the record of a dot and the detection of a faulty record between the recording head 51 and the faulty record detection unit 110. Therefore, a faulty record can be correctly detected without the necessity to correct the dot position error of a detected image caused by a position error of the conveying system from the recording head to the faulty record detection unit 110. Furthermore, by using the conveying mechanism in the form of a drum, the recording medium 5 causes almost no time shift in the conveying direction while it passes between the recording head 51 and the vision of the faulty record detection unit 110. Therefore, it is not necessary to correct the timing in the conveying direction when a faulty record is detected. Although it is necessary in some rare cases, a faulty record can be correctly detected in the conveying direction by using a rotation amount detection encoder etc. incorporated into the drum.

Furthermore, as shown in FIG. 1 in the present mode for embodying the present invention, the recording head 51 and the faulty record detection unit 110 are fixed to the coupling plate 111 as a common member, and then fixed to the body frame 25, thereby arranging the recording head 51 and the faulty record detection unit 110 to be positioned on the perimeter of the first drum 30 in which the shaft is fixed to the body frame 25.

With the configuration, the effect of the relative position change between the recording head 51 and the faulty record detection unit 110 by a change in vibration, temperature, etc. can be reduced, and a faulty record can be correctly detected without an effect of a change in environment.

The configuration can be set such that the recording head 51 and the faulty record detection unit 110 can be directly fixed to the body frame 25 without using the coupling plate 111. In this case, since the recording head 51, the faulty record detection unit 110, the rotation shaft 30*a* of the first drum 30, and the rotation shaft 40*a* of the second drum 40 are fixed to the body frame 25 as a common fixing member, the effects of the respective relative change positions can be reduced.

Described next is a variation example of the first mode for embodying the present invention.

Figure 4:
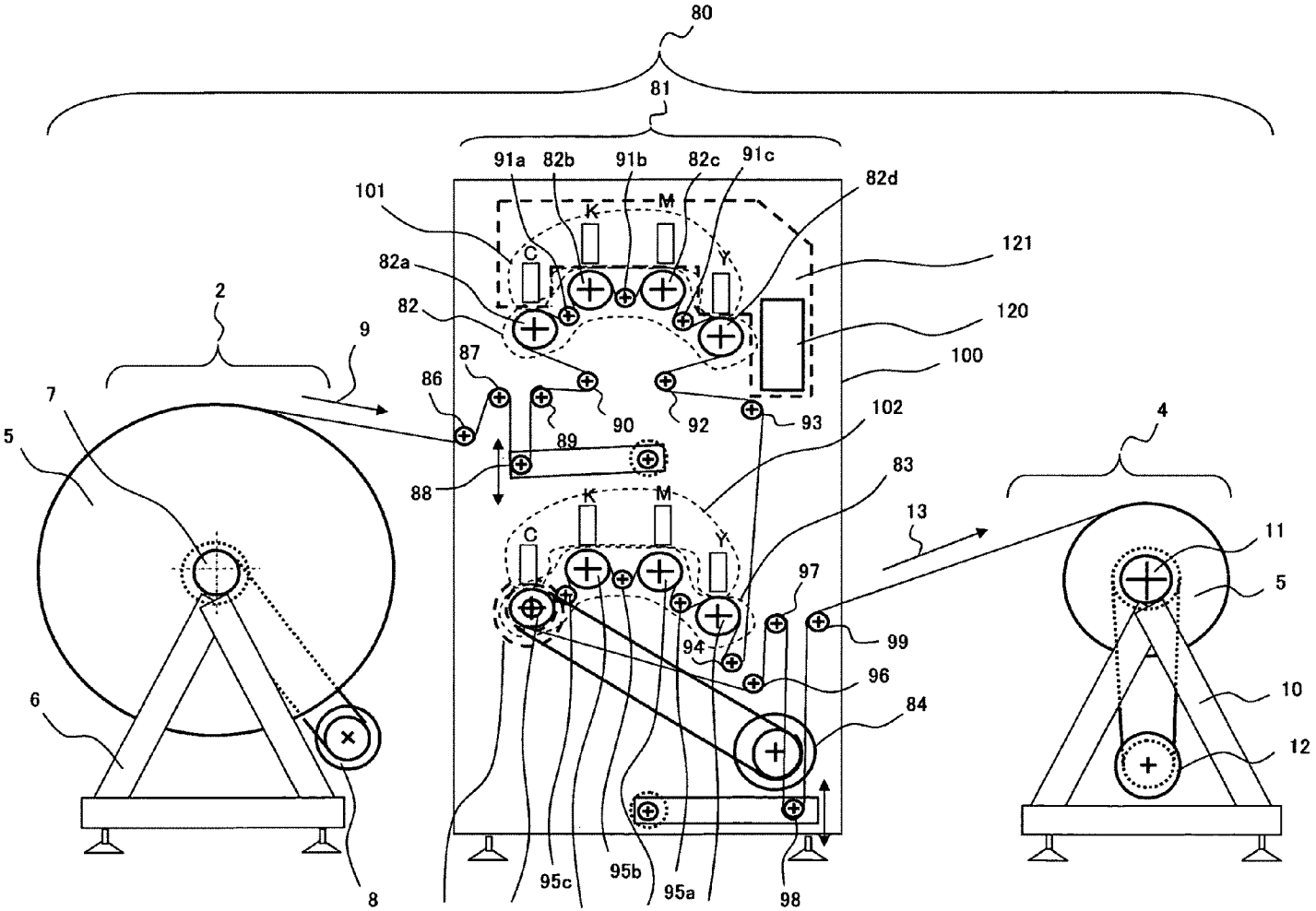
FIG. 4 is a rough front view of the image recording apparatus of a variation example according to the first mode for embodying the present invention.
Figure 5:
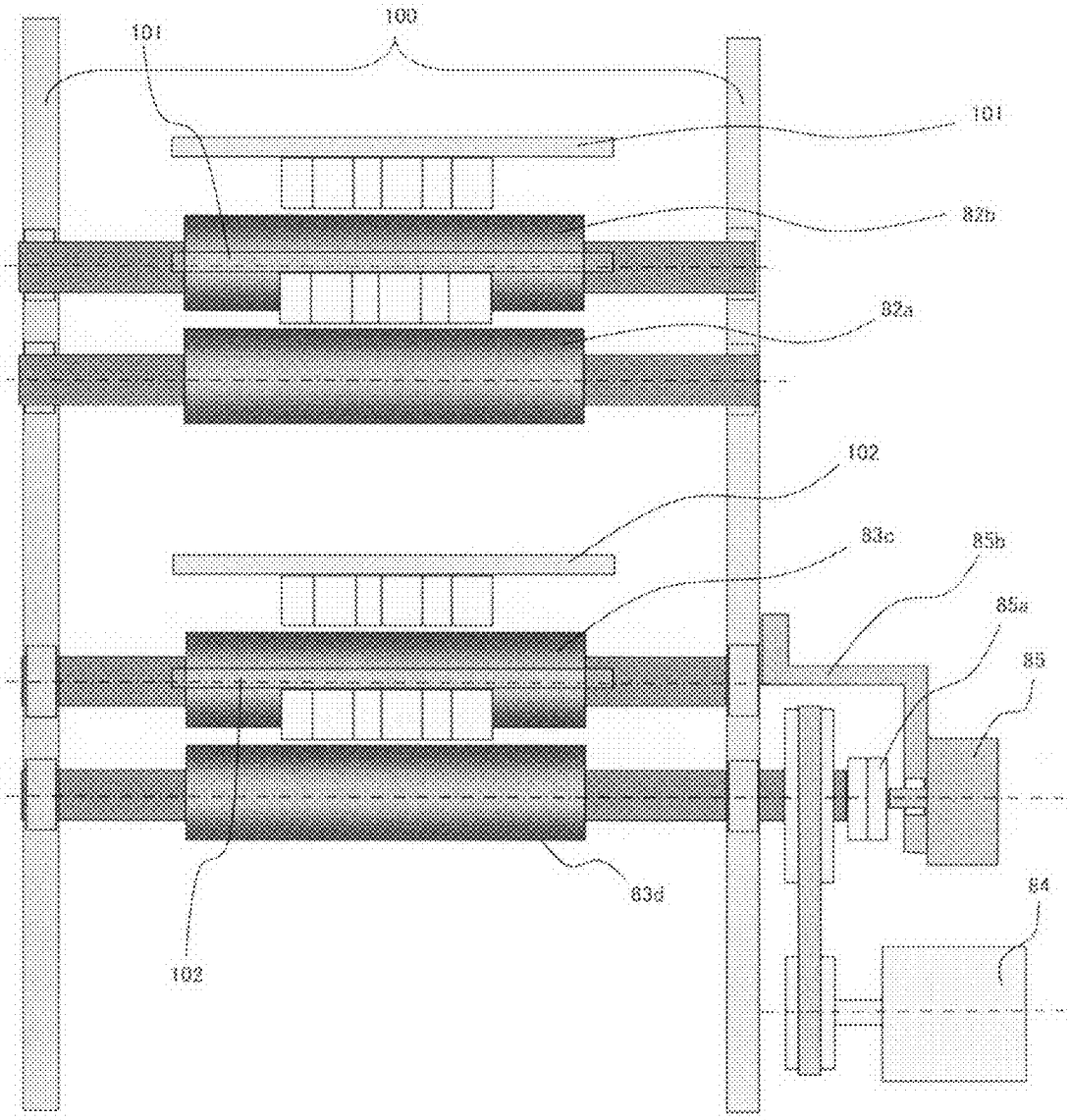
FIG. 5 is a rough side view of the conveying system of the printer unit of the image recording apparatus of a variation example according to the first mode for embodying the present invention.

FIGS. 4 and 5 are explanatory view of a variation example of the first mode for embodying the present invention. FIG. 4 is a rough front view of the conveyance path of the recording medium 5 in an image recording apparatus 80, and FIG. 5 is a rough side view of a printer unit 81 of the image recording apparatus 80.

The image recording apparatus 80 in the present variation example includes the unwinder unit 2, the printer unit 81, and the rewinder unit 4. The configuration of the rewinder unit 4 is the same as that in the first mode for embodying the present invention.

The printer unit 81 is described first. The printer unit 81 introduces the recording medium 5 conveyed from the unwinder unit 2, and winds the recording medium 5 around a first drum unit 82 and holds it thereon. Then, it conveys the recording medium 5 immediately below a first print unit 101 arranged opposite the first drum unit 82, and performs printing on the surface of the recording medium 5. After the printing on the surface of the first print unit 101 the recording medium 5 is wound around a second drum unit 83, and held thereon. Then, the recording medium 5 is conveyed immediately below a second print unit 102 arranged opposite the second drum unit 83, data is printed on the reverse of the recording medium 5, and the recording medium 5 is transmitted to the rewinder unit 4.

The printer unit 81 includes a conveying unit of the recording medium 5 having a plurality of rollers, the first drum unit 82, and the second drum unit 83, the body frame 100, the first print unit 101, and the second print unit 102 as shown in FIGS. 4 and 5.

The conveying unit of the recording medium 5 is described first. The recording medium 5 unrolled from the unwinder unit 2 is conveyed to the first drum unit 82 through a free roller 86, a free roller 87, a first dancer roller 88, a free roller 89, and a free roller 90.

As in the first mode for embodying the present invention, the first dancer roller 88 is held on the body frame 100 at the tip of an arm having a rotation center. The first dancer roller 88 has a tension generation unit for applying a tension to the recording medium 5 wound around the first dancer roller 88 by the tare of the first dancer roller 88 and the arm. The tension generation unit also has the function of taking up the slack caused by the fluctuation of the tension from a displaced core in the recording medium 5 held by the unwinder unit 2.

The rotation center is provided with a potentiometer for detecting the position of the rotation when the first dancer roller 88 moves up and down. According to the output signal of the potentiometer, the clutch connected to the paper pipe fixing shaft 7 of the unwinder unit 2 is operated, thereby controlling the tension of the recording medium 5. The free rollers 86, 87, 88, and 89 are supported by the body frame 100 such that they can rotate.

Described next is the configuration of the first drum unit 82. The first drum unit 82 is formed by the four first drums 82*a*, 82*b*, 82*c*, and 82*d* arranged opposite the recording heads for four colors, and three free rollers 91*a*, 91*b*, and 91*c* arranged such that the winding angle of the recording medium 5 can be 180° or more on the way to the first drums 82*a*, 82*b*, 82*c*, and 82*d*. Each drum and each free roller are hollow aluminum cylinders, and the rotation shaft is supported by the body frame 100 such that the shaft can rotate.

The first drums 82*a*, 82*b*, 82*c*, and 82*d* are arranged in the form of a fan to minimize the width of the printer unit 81. The vertical drag is applied to the outer surface of each of the first drums 82*a*, 82*b*, 82*c*, and 82*d* by the tension of the start and the end of the roll of the recording medium 5 on the first drum. Thus, the recording medium 5 is tightly held on the first drums 82*a*, 82*b*, 82*c*, and 82*d* by the friction generated between the first drums 82*a*, 82*b*, 82*c*, and 82*d* and the recording medium 5. That is, the recording medium 5 does not slip on the first drums 82*a*, 82*b*, 82*c*, and 82*d*.

Thus, the first drums 82*a*, 82*b*, 82*c*, and 82*d* are driven drums rotating by the second drum unit 83 through the recording medium 5.

At and after the end of the first drum unit 82, the recording medium 5 is conveyed to the second drum unit 83 through free rollers 92, 93, and 94. The free rollers 92, 93, and 94 are also supported by the body frame 100 such that the rollers can rotate.

Described below is the configuration of the second drum unit 83. Like the first drum unit 82, the second drum unit 83 is formed by the four second drums 83*a*, 83*b*, 83*c*, and 83*d* arranged opposite the recording heads for four colors, and three free rollers 95*a*, 95*b*, and 95*c* arranged such that the winding angle of the recording medium 5 can be 180° or more on the way to the second drums 83*a*, 83*b*, 83*c*, and 83*d*. Each drum and each free roller are hollow aluminum cylinders, and the rotation shaft is rewinder unit 4 supported by the body frame 100 such that the shaft can rotate. The second drums 83*a*, 83*b*, 83*c*, and 83*d* are arranged in the form of a fan to minimize the width of the printer unit 81. The vertical drag is applied to the outer surface of each of the second drums 83*a*, 83*b*, 83*c*, and 83*d* by the tension of the start and the end of the roll of the recording medium 5 on the first drum. Thus, the recording medium 5 is tightly held on the second drums 83*a*, 83*b*, 83*c*, and 83*d* by the friction generated between the second drums 83*a*, 83*b*, 83*c*, and 83*d* and the recording medium 5. That is, the recording medium 5 does not slip on the second drums 83*a*, 83*b*, 83*c*, and 83*d*.

The recording medium 5 is conveyed by the driving force of a driving motor 84 coupled to the rotation shaft of the second drum unit 83*d* through the pulley and the belt. Thus, the second drum unit 83*d* can be a driving drum, and the second drums 83*a*, 83*b*, and 83*c* can be driven drums.

The encoder 85 is coupled to the rotation shaft of the second drum unit 83*d* through a coupling 85*a*. The housing of the encoder 85 is fixed to one end of an encoder fixing member 85*b* having an L-shaped section. The other end of the encoder fixing member 85*b* is fixed to the back of the body frame 100. With the configuration, the rotation shaft of the encoder 85 rotates with the rotation of the second drum unit 83*d*, and outputs a detection pulse corresponding to the rotation position of the second drum unit 83*d*. The detection pulse is input to the driving substrate for driving the recording heads of the first print unit 101 and the second print unit 102 but not shown in the attached drawings. The recording heads discharge ink in synchronization with the detection pulse. That is, the recording medium 5 is conveyed based on the detection pulse at a constant speed without slippage on the first drum unit 82 and the second drum unit 83. Therefore, the discharge drive of the recording heads of the first print unit 101 and the second print unit 102 can be controlled.

The encoder 85 is set such that a printing operation of 1 dot per pulse can be performed as in the first mode for embodying the present invention, and determines the diameter of the second drum unit 83*d* from the resolution of 300 dpi in the conveying direction in printing and the number of pulses of the encoder 85. Furthermore, in the present mode for embodying the present embodiment, the diameters of the first drums 82*a*, 82*b*, 82*c*, and 82*d* and the second drums 83*a*, 83*b*, and 83*c* are the same as the diameter of the second drum unit 83*d*. With the configuration, the recording heads of the first print unit 101 and the second print unit 102 can discharge ink in synchronization with the detection pulse of the encoder 85, and perform printing with the resolution of 300 dpi in the conveying direction.

At and after the end of the roll of the second drum unit 83, the recording medium 5 is transmitted to the rewinder unit 4 through free roller 96 and 97, a second dancer roller 98, and a free roller 99.

As in the first mode for embodying the present invention, the second dancer roller 98 is held on the body frame 100 at the tip of an arm having a rotation center. The second dancer roller 98 has a tension generation unit for applying a tension to the recording medium 5 wound around the second dancer roller 98 by the tare of the second dancer roller 98 and the arm. The tension generation unit also has the function of taking up the slack caused by the fluctuation of the tension from a displaced core in the recording medium 5 held by the rewinder unit 4. The rotation center is provided with a potentiometer for detecting the position of the rotation when the second dancer roller 98 moves up and down. According to the output signal of the potentiometer, the clutch connected to the paper pipe fixing shaft 11 of the rewinder unit 4 is operated, thereby controlling the tension of the recording medium 5.

Then, the first print unit 101 and the second print unit 102 are described. As shown in FIGS. 4 and 5, the first print unit 101 and the second print unit 102 are ink discharge devices for discharging ink to the recording medium 5.

The first print unit 101 and the second print unit 102 have recording heads of a total of four colors, that is, cyan (C), black (K), magenta (M), and yellow (Y). As in the first mode for embodying the present invention, each recording head is zigzag arranged and fixed on the head holding plate. The nozzle surface formed on the recording head is arranged opposite the print surface of the recording medium 5 held on the outer perimeter of the first drums 82*a*, 82*b*, 82*c*, and 82*d* and the second drums 83*a*, 83*b*, 83*c*, and 83*d*, and the ink discharge direction of all recording heads matches the vertical direction of the apparatus. By matching the ink discharge direction of all recording heads, the change in characteristics caused by the difference in the fixing posture of a recording head can be suppressed.

Described below is the conveying operation of the recording medium 5 in the present variation example.

When the conveying operation of the recording medium 5 is started in the present mode for embodying the present invention, the operation of applying a tension to the recording medium 5 is first performed. The tension of the recording medium 5 is controlled by operating the clutch coupled to the paper pipe fixing shaft 7 according to the output signal of the potentiometer such that the first dancer roller 88 can be in the neutral position. Thus, upstream the conveying path of the recording medium 5, that is, from the first dancer roller 88 to the start of the roll of the recording medium 5 at the first drum 82*a*, the tension of half the tare of the first dancer roller 88 and the arm 88*b* is applied.

On the other hand, a clutch coupled to the paper pipe fixing shaft 11 is operated according to the output signal of the potentiometer such that the second dancer roller 98 can be set in a neutral position, and the tension of the recording medium 5 is controlled. Thus, downstream the conveying path of the recording medium 5, that is, from the end of the roll of the second drum 83*d* to the second dancer roller 98, the tension of half the tare of the second dancer roller 98 and the arm 98*b* is applied.

At this time, the vertical drag is applied to the outer surface of the first drums 82*a*, 82*b*, 82*c*, and 82*d* by the tension of the start and the end of the roll of the recording medium 5 on the first drums 82*a*, 82*b*, 82*c*, and 82*d*. Thus, the recording medium 5 is tightly held on the first drums 82*a*, 82*b*, 82*c*, and 82*d* by the friction generated between the first drums 82*a*, 82*b*, 82*c*, and 82*d* and the recording medium 5.

Similarly, the vertical drag is applied to the outer surface of the second drums 83*a*, 83*b*, 83*c*, and 83*d* by the tension of the start and the end of the roll of the recording medium 5 on the second drums 83*a*, 83*b*, 83*c*, and 83*d*. Thus, by the friction between the second drums 83*a*, 83*b*, 83*c*, and 83*d* and the recording medium 5, the recording medium 5 is tightly held on the second drums 83*a*, 83*b*, 83*c*, and 83*d*.

When the driving motor 84 coupled to the second drum 83*d*, the unrolling driving motor 8 of the unwinder unit 2, and the take-up driving motor 12 of the rewinder unit 4 are driven, thereby driving the first drums 82*a*, 82*b*, 82*c*, and 82*d* and the second drums 83*a*, 83*b*, and 83*c*, thereby conveying the recording medium 5. At this time, the recording medium 5 can be conveyed without slipping between the outer surfaces of the first drums 82*a*, 82*b*, 82*c*, and 82*d* and the second drums 83*a*, 83*b*, 83*c*, and 83*d* and the recording medium 5.

In the variation example of the first mode for embodying the present invention, as in the first mode for embodying the present invention, the recording head 51 and a faulty record detection unit 120 are arranged as fixed for the first drum unit 82 and the body frame 100, thereby obtaining the same effect as in the first mode for embodying the present invention.

That is, as shown in FIG. 4, the conveying system is used to allowing the recording medium 5 to tightly contacting the surface of the cylinder of the first drums 82*a*, 82*b*, 82*c*, and 82*d*, and the faulty record detection unit 120 is positioned downstream the first print unit 101 by using the first print unit 101 and the faulty record detection unit 120 fixed to the body frame 100 through a coupling plate 121.

With the configuration, the effect of a relative positional change between the first print unit 101 and the faulty record detection unit 120 can be reduced, and a faulty record can be correctly detected without an effect of an environmental change.

The first print unit 101 and the faulty record detection unit 120 can be fixed directly to the body frame 100 without using the coupling plate 121.

Furthermore, according to the present mode for embodying the present invention, the second drum unit 83*d* is a driving drum, but any one of other drums can be a driving drum. Similarly, the encoder 85 is connected only to the second drum unit 83*d*, but the encoder 85 can be coupled to any one of the other drums.

Next, the second mode for embodying the present invention is described below.

Figure 6:
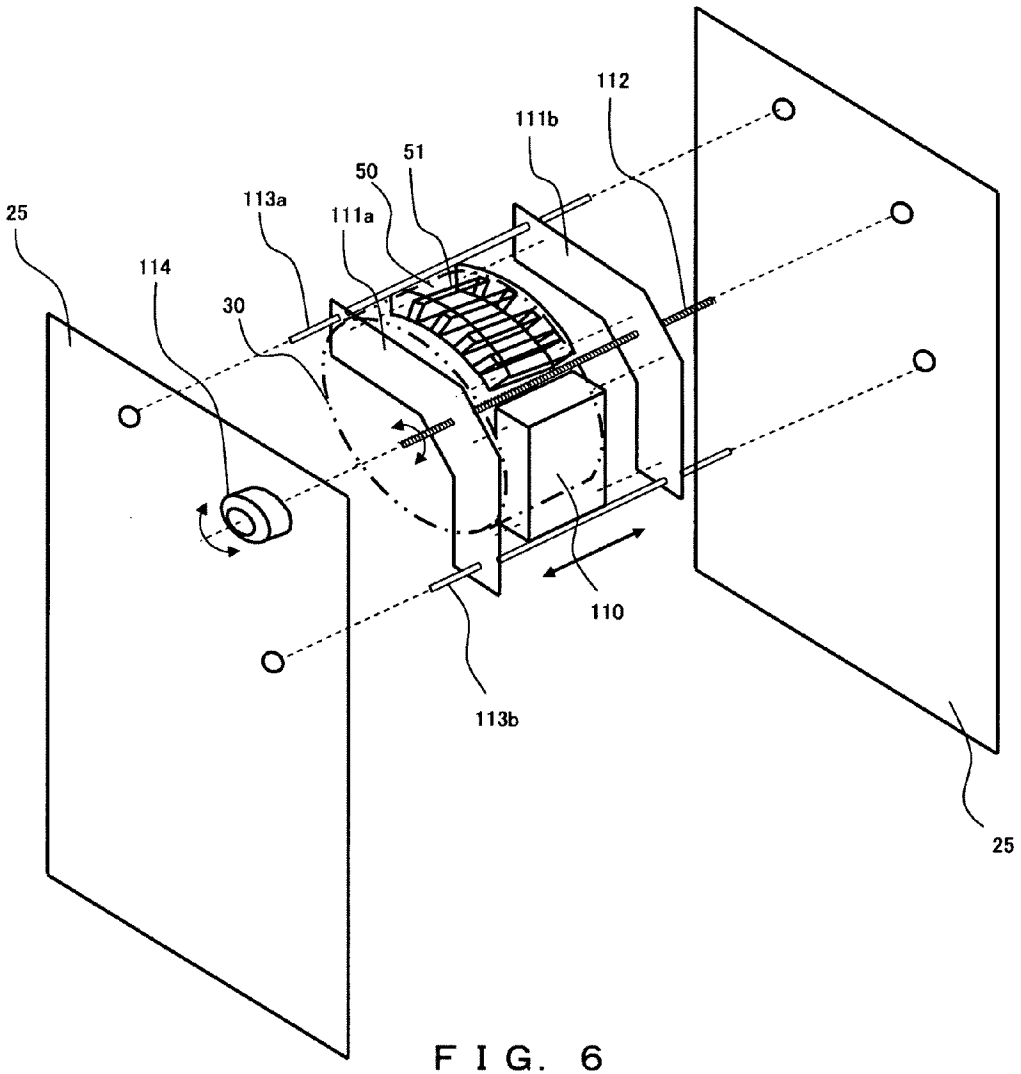
FIG. 6 is a rough perspective view of the travel mechanism in the primary scanning direction of the first print unit and the faulty record detection unit.

FIG. 6 is an explanatory view of the second mode for embodying the present invention. The present mode for embodying the present invention basically corresponds to the configuration of the printer unit 3 shown in FIG. 1, and the same as in the first mode for embodying the present invention.

In FIG. 6, the first print unit 50 including the recording head 51 and the faulty record detection unit 110 tightly contacts the perimeter of the first drum 30, and enters the positional relationship with the conveyed recording medium 5 such that recording and faulty record detecting processes can be performed at an appropriate position by temporarily fixing them to coupling plates 111*a* and 111*b* respectively. These components are fixed to the body frame 25 through guides 113*a* and 113*b* capable of controlling travel in the primary scanning direction and a screw 112 capable of controlling travel in the primary scanning direction.

With the above-mentioned configuration, the screw 112 rotates by rotation-controlling the motor 114 fixed to the body frame 25, and the first print unit 50 including the recording head 51 and the faulty record detection unit 110 incorporated by fixing to the coupling plates 111*a* and 111*b* is travel-controlled in the primary scanning direction with respect to the first drum 30.

In the roller unit, the unwinder unit 2, etc. other than the first drum 30, when the operation status of the recording medium 5 becomes unstable or when the control of a tension cannot be constantly performed, there can be the possibility that data cannot be recorded in a predetermined position in the primary scanning direction of the recording medium 5.

In this case, the capture unit built in the faulty record detection unit 110 reads the position of the end portion of the recording medium 5, obtains the amount of position change, rotation-controls the motor 114 to cancel the amount, thereby rotating the screw 112. Then, the first print unit 50 and the faulty record detection unit 110 incorporated into the coupling plates 111*a* and 111*b* are controlled to maintain the relative positions, and maintain constant appropriate positions with respect to the position in the primary scanning direction of the recording medium 5. Thus, the record position quality for the recording medium can be maintained and the effect of degrading the faulty record detection can be prevented.

However, if the position control of the first print unit 50 and the faulty record detection unit 110 is performed during the image recording and faulty record detecting processes, the record dot position does not match the detection view, and a faulty record cannot be correctly detected. Therefore, it is preferable that the control is selectively performed when the white paper portion having no recording dot passes between the recording head 51 and the view of the faulty record detection unit 110 during the image recording process.

As described above, according to the present mode for embodying the present invention, the recording head and the faulty record detection unit are arranged on the perimeter of the same rotating drum, and the recording head and the faulty record detection unit are fixed to the same member so that the shift of the test view position with respect to the dot position recorded on the recording medium can be reduced. As a result, it is not necessary to correct the position of a read image in the primary scanning direction, or correct timing in the secondary scanning direction, or it is necessary to make only a small amendment, thereby obtaining an image recording apparatus having an easy and correct faulty record detection unit.

Furthermore, by rotation-controlling the screw 112 by feeding back the position information obtained by the capture unit of the faulty record detection unit detecting the position of the end portion of a recording medium, a position can be determined in real time in the primary scanning direction for a drum by an incorporated recording head and faulty record detection unit 110. Therefore, although the medium position of a drum is shifted in the primary scanning direction by the conveying mechanism system of a recording medium, the shift of the test view position with respect to the dot position recorded on the recording medium can be minimized. As a result, it is not necessary to correct the geometry of a read image, or it is necessary only to make a small amendment, thereby obtaining an image recording apparatus having an easy and correct faulty record detection unit without a record position shift in the primary scanning direction on the recording medium.

In the description above, the recording head and the faulty record detection unit 110 is moved in the primary scanning direction with respect to the first drum 30. However, a capture unit built in the faulty record detection unit 110 can read the end portion position of recording medium 5, obtain the skew angle, correct the skew around the vertical shaft with respect to the surface of the recording medium in addition to the primary scanning direction as a countermeasure to the skew of the recording medium. It is also considered to correct both in the primary scanning direction and the skew.

In the description above, the recording medium tightly contacts the drum by the applied vertical drag to the outer surface of the drum by the tension working on the recording medium. However, the method of a recording medium tightly contacting a drum is not limited to this, but a statically adsorbing method can be used, or one or more nip roller are arranged on a drum to allow a recording medium to tightly contact a drum by nipping the recording medium with the drum and the nip roller(s).

In the descriptions above, the present invention is applied to a recording head for recording data on the surface of the recording medium 5, but a faulty record detection unit can be arranged on the recording head on the reverse of the recording medium 5 to check a faulty record.

Furthermore, in any of the above-mentioned modes for embodying the present invention, in the image recording apparatus for horizontally conveying a recording medium with respect to a recording head such as a conveying unit etc. having a belt, for example, a belt platen etc., the recording head and the faulty record detection unit can be incorporated into one unit. In addition, the recording medium can be roll paper or cut paper.

The present invention can be applied to at least one drum, and can be applied to a plurality of drum to perform double-sided printing as necessary. Additionally, as means for travel-controlling in a primary scanning direction, a recording medium can be continuously travel-controlled using a guide mechanism after detecting the position of the end portion of a recording medium by a capture system of a faulty record detection unit.

Furthermore, as an image recording apparatus according to the present mode for embodying the present invention, it can be applied to not only an inkjet printer, but also a printer in a static system, a thermal transfer system, etc.

Described above are the modes for embodying the present invention, but the present invention is not limited to the above-mentioned modes, and can be improved and modified within the gist of the present invention. For example, some components can be removed from the entire configuration in each of the modes for embodying the present invention described above, or different components in each mode for embodying the present invention can be appropriate combined.

What is claimed is:

1. An image recording apparatus, comprising:

a drum for holding a recording medium by winding the recording medium such that the recording medium tightly contacts a surface of a cylinder of the drum, and for conveying the recording medium;

a recording medium conveying mechanism;

a recording head for recording an image on the being-conveyed recording medium, wherein the recording head is arranged in a direction orthogonal to a conveying direction of the recording medium;

a faulty record detection unit for detecting a faulty record of the image recorded by the recording head; and a control unit for controlling the drum, the recording head, and the faulty record detection unit, wherein both the recording head and the faulty record detection unit are fixed to a same coupling member such that: (i) both the recording head and the faulty record detection unit are arranged opposite to a winding portion of the drum where the recording medium is windingly held tightly contacting the surface of the cylinder of the drum, and (ii) the faulty record detection unit is arranged more downstream in the conveying direction than the recording head, and wherein the coupling member is fixed to a fixing member that holds a rotation shaft of the drum.

2. The apparatus according to claim 1, further comprising a position sensor for detecting a position of an end portion of the recording medium which is conveyed on the drum, wherein an incorporated unit of the recording head and the faulty record detection unit fixed to the same coupling member is travel-controlled in a primary scanning direction according to information about the detected position of the end portion of the recording medium.

3. The apparatus according to claim 2, wherein the faulty record detection unit comprises the position sensor.

4. The apparatus according to claim 1, wherein a back tension is applied to a start of a roll of the recording medium that is wound and held on the drum such that a vertical drag operates against the surface of the cylinder of the drum.

5. An image recording apparatus which records an image on a recording medium, comprising:

a rotatable drum for holding the recording medium by winding the recording medium such that the recording medium tightly contacts a surface of a cylinder of the drum, and for conveying the recording medium;

a recording head which has a recording area that extends over a width of the recording medium; and a faulty record detection unit for detecting a faulty record of an image recorded by the recording head, wherein the image is recorded by conveying the recording medium to the recording head;

wherein both the recording head and the faulty record detection unit are fixed to a same coupling member such that: (i) both the recording head and the faulty record detection unit are arranged opposite to a winding portion of the drum where the recording medium is windingly held tightly contacting the surface of the cylinder of the drum, and (ii) the faulty record detection unit is arranged more downstream in a conveying direction than the recording head; and wherein the coupling member is fixed to a fixing member that holds a rotation shaft of the drum.

6. The apparatus according to claim 4, wherein a back tension is applied to an end of the roll of the recording medium that is wound and held on the drum such that the vertical drag operates against the surface of the cylinder of the drum.

* * * * *